US007243632B2

(12) United States Patent
Hu

(10) Patent No.: US 7,243,632 B2
(45) Date of Patent: Jul. 17, 2007

(54) SMALL FOUR-STROKE GASOLINE ENGINE WITH OIL MIST LUBRICATION

(76) Inventor: Ji-Rong No Hu, Office of the Chief Engineer, Xingyue Group, Gushan Industrial Area, Yongkang City, Zhejiang Province (CN) 321307

( * ) Notice: Subject to any disclaimer, the term of this patent is extended or adjusted under 35 U.S.C. 154(b) by 0 days.

(21) Appl. No.: 10/569,027

(22) PCT Filed: Aug. 27, 2004

(86) PCT No.: PCT/CN2004/000998

§ 371 (c)(1),
(2), (4) Date: Feb. 17, 2006

(87) PCT Pub. No.: WO2005/026504

PCT Pub. Date: Mar. 24, 2005

(65) Prior Publication Data

US 2006/0254556 A1 Nov. 16, 2006

(30) Foreign Application Priority Data

Aug. 29, 2003 (CN) ..... 03 2 10165

(51) Int. Cl.
*F01M 1/00* (2006.01)
*F01M 1/04* (2006.01)

(52) U.S. Cl. ..... 123/196 R; 184/6.5; 184/6.26; 184/11.1; 184/104.3

(58) Field of Classification Search ..... 123/196 R; 184/6.5, 6.8, 6.9, 6.26, 11.1, 104.3
See application file for complete search history.

(56) References Cited

U.S. PATENT DOCUMENTS 6,394,061 B2 * 5/2002 Ryu et al. ..... 123/196 R

* cited by examiner

*Primary Examiner*—Noah P. Kamen

(57) ABSTRACT

The present invention relates to a small four-stroke gasoline engine with oil mist lubrication. The lubrication oil way of the engine includes a crankshaft chamber B, a camshaft chamber C, an upper rocker arm chamber D and a condensation chamber E. The camshaft chamber C communicates with the upper rocker arm chamber D via a tappet cavity 13. The upper rocker arm chamber D communicates with the condensation chamber E. An oil mist chamber A is surrounded by an upper case body 3 and a lower case body 4 at the side of the crankshaft chamber B, the bottom of the oil mist chamber A communicates with the crankshaft chamber B. An oilsplash impeller 2 is fixed on a crankshaft, which extends into the oil mist chamber A. An oil way 12 is provided on the upper case body 3 between the oil mist chamber A and the camshaft chamber C. An oil return way 15 is provided on a cylinder head assembly 5. An oil return way 14 is provided on the upper case body 3. An upper interface of the oil return way 15 communicates with the upper rocker arm chamber D, a lower interface of the oil return way 15 communicates with the oil return way 14, and a lower interface of the oil return way 14 communicates with the crankshaft chamber B. The conventional lubricating mode is changed by the structure of the invention, which makes use of the pressure change during the reciprocating movement of a piston assembly 8 to attain the circulation of oil. The structure is simple, reliable in operation and has small consumption in power.

3 Claims, 3 Drawing Sheets

SMALL FOUR-STROKE GASOLINE ENGINE WITH OIL MIST LUBRICATION

BACKGROUND OF THE INVENTION

The present invention relates to a gasoline engine and more particularly pertains to a small four-stroke gasoline engine with improvements on its lubricant passage ways and its mode of lubrication.

It is known that existing small four-stroke gasoline engines apply splashing lubrication in conjunction with pressure oil injection as its mode of lubrication, that is, to splash or make use of pressure to spread lubricants onto the surfaces of parts for lubrication. This mode is characterized in that it is required to dispose on the machine the structures of the lubricant pumps and splashing devices, which are relatively complicated. While the lubricating effects are general, there are dead angles and power consumption is large.

BRIEF SUMMARY OF THE INVENTION

In view of the aforesaid disadvantages now present in the prior art, the present invention provides a small four-stroke gasoline engine with oil mist lubrication which is reasonably simple in construction and capable of lubricating every part by making use of the better mobility of oil mists.

To attain this, the present invention generally comprises an upper and a lower case bodies, a crankshaft assembly, a piston assembly, a cylinder head assembly, a cylinder head cover and a lubrication oil way of engine. The lubrication oil way of engine includes a crankshaft chamber, a camshaft chamber, an upper rocker arm chamber and a condensation chamber. The camshaft chamber is connected to the upper rocker arm chamber via a tappet cavity. The upper rocker arm chamber communicates with the condensation chamber. An oil mist chamber is formed by an upper case body and a lower case body on one side of the crankshaft chamber. The bottom of the oil mist chamber communicates with the crankshaft chamber. An oilsplash impeller is fixed onto the crankshaft which extends into the oil mist chamber. An oil way is provided on the upper case body which is in between the oil mist chamber and the camshaft chamber. An oil return way is provided on the cylinder head assembly. An oil return way is provided on the upper case body. The upper interface of the cylinder head oil return way communicates with the upper rocker arm chamber, and its lower interface is connected to the oil return way of the upper case body. The lower interface of the oil return way of the upper case body communicates with the crankshaft chamber.

To make the lubricating oil mists circulate in the lubrication oil way of engine following the pressure changes generated by the up and down movements of the piston assembly, a reed valve is provided at the interface of the cylinder head assembly between the oil return way of the cylinder head and the oil return way of the upper case body.

To ensure reliable circulation of the lubricating oil mists in the lubrication oil way of engine, a spacing plate is provided on the reed valve.

By means of the aforesaid construction, the oilsplash impeller rotates with the crankshaft, causing the lubricant in the oil mist chamber to produce lubricating oil mists. The lubricating oil mists circulate in the lubrication oil way of engine resulting from the pressure changes generated by the up and down movements of the piston assembly. The engine is capable of lubricating every part in it by making use of the better mobility of oil mists.

It is an object of the present invention to provide a small four-stroke gasoline engine with oil mist lubrication which is of simple construction, reliable and even lubrication, small power consumption, low production cost and stable product quality and so forth, thereby overcoming the disadvantages of the prior art.

DETAILED DESCRIPTION OF THE INVENTION

Figure 1:
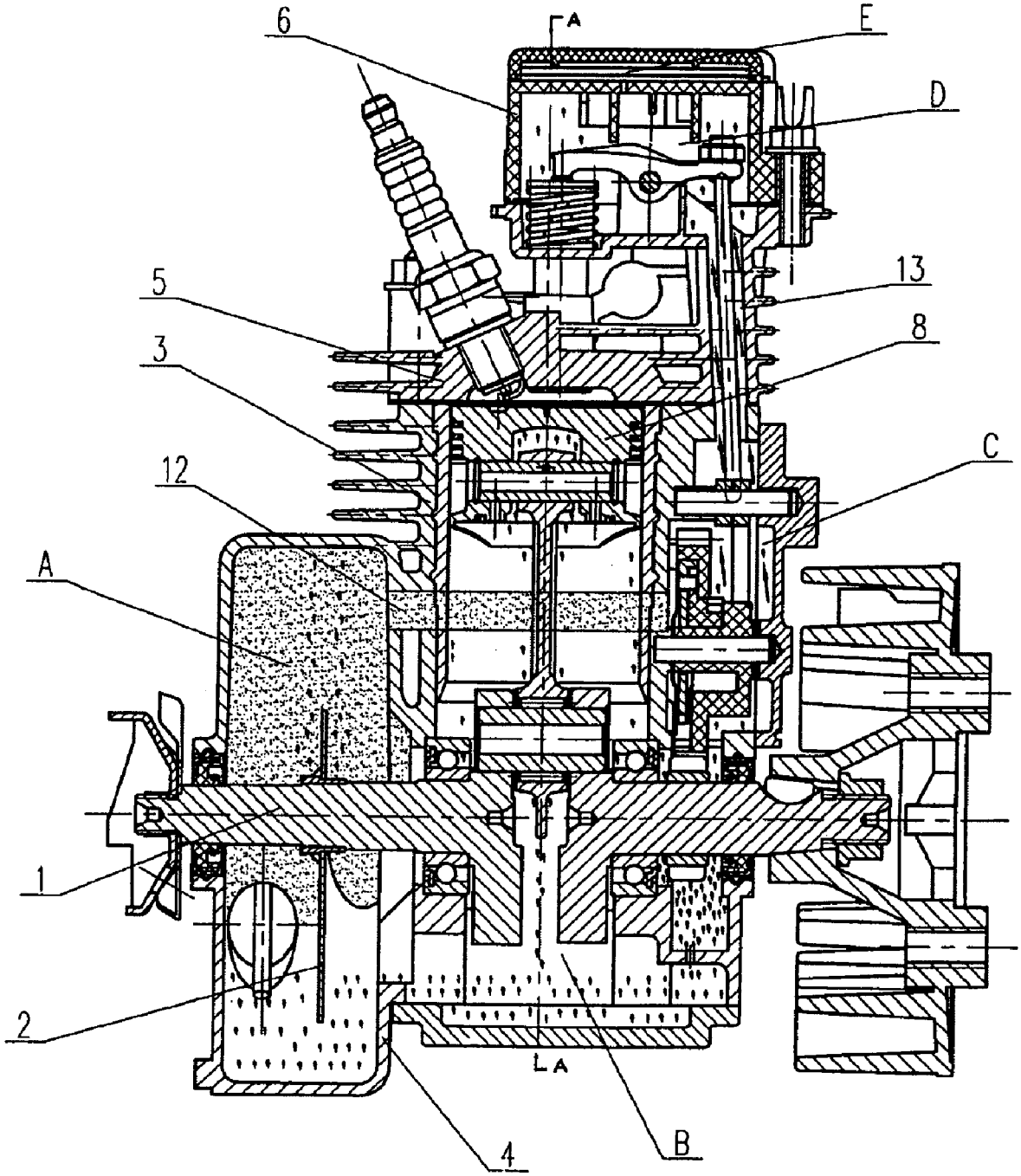
FIG. 1 shows the construction of the present invention.

The present invention is further described in detail with the following embodiment and the accompanying drawings. As illustrated in FIGS. 1 to 4, the embodiment is a small four-stroke gasoline engine with oil mist lubrication, which comprises an upper case body 3, a lower case body 4, a crankshaft assembly 1, a piston assembly 8, a cylinder head assembly 5, a cylinder head cover 6 and a lubrication oil way of engine. The lubrication oil way of engine includes a crankshaft chamber B, a camshaft chamber C, an upper rocker arm chamber D and a condensation chamber E. The camshaft chamber C is connected to the upper rocker arm chamber D via a tappet cavity 13. The upper rocker arm chamber D communicates with the condensation chamber E. The condensation chamber E is a long and narrow space, the functions of which are to provide space for oil mists to condense and for the convenience of their backflow. Further, by means of communicating an air pipe 9 with an air intake pipe 10, the pressure therein can be balanced. An oil mist chamber A is formed by an upper case body 3 and a lower case body 4 on one side of the crankshaft chamber A. The bottom of the oil mist chamber A communicates with the crankshaft chamber B. An oilsplash impeller 2 is fixed onto the crankshaft which extends into the oil mist chamber A. An oil way 12 is provided on the upper case body 3 which is in between the oil mist chamber A and the camshaft chamber C. An oil return way 15 is provided on the cylinder head assembly 5. An oil return way 14 is provided on the upper case body 3. The upper interface of the cylinder head oil return way 15 communicates with the upper rocker arm chamber D, and its lower interface is connected to the oil return way of the upper case body 14. The lower interface of the oil return way of the upper case body 14 communicates with the crankshaft chamber B. A reed valve 7 is provided at the interface of the cylinder head assembly 5 between the oil return way of the cylinder head 15 and the oil return way of the upper case body 14. To ensure reliable operation of the reed valve 7, a spacing plate 11 is provided at the bottom of the reed valve 7.

For the sake of conveniently describing the working process of the circulation of the lubricating oil mists in the lubrication oil way of engine when the present invention is in operation, the pressure of each chamber is assumed as follows: the pressure of the condensation chamber E—P0, the pressure of the camshaft chamber C—P1, the pressure of the upper rocker arm chamber D—P2, the pressure of the crankshaft chamber B—P3, and the pressure of the oil mist chamber A—P4. When the present invention is in operation, the oilsplash impeller 2 provided on the crankshaft assembly 1 rotates with the crankshaft, thereby swirling the lubricant at the bottom of the oil mist chamber A to form oil mists dispersing in the oil mist chamber A. By means of opening or closing the reed valve 7 provided at the bottom of the cylinder head assembly 5, according to the pressure changes at each chamber, the circulating direction of the lubrication oil way can be controlled.

When the piston assembly 8 moves downwards, the pressure of the crankshaft chamber B P3 increases, and the relationship of each chamber's pressure is P3>P4>P1>P2>P0. The oil mists pass through the upper case body oil way 12 and enter from the oil mist chamber A into the camshaft chamber C. The oil mists of the camshaft chamber C enter via the tappet cavity 13 into the upper rocker arm chamber D. The oil mists of the upper rocker arm chamber D enter the condensation chamber E. The oil mist direction of the oil way is shown in FIG. 1 by the arrow heads therein. At this point of time, the reed valve 7 is in a closed state.

Figure 2:
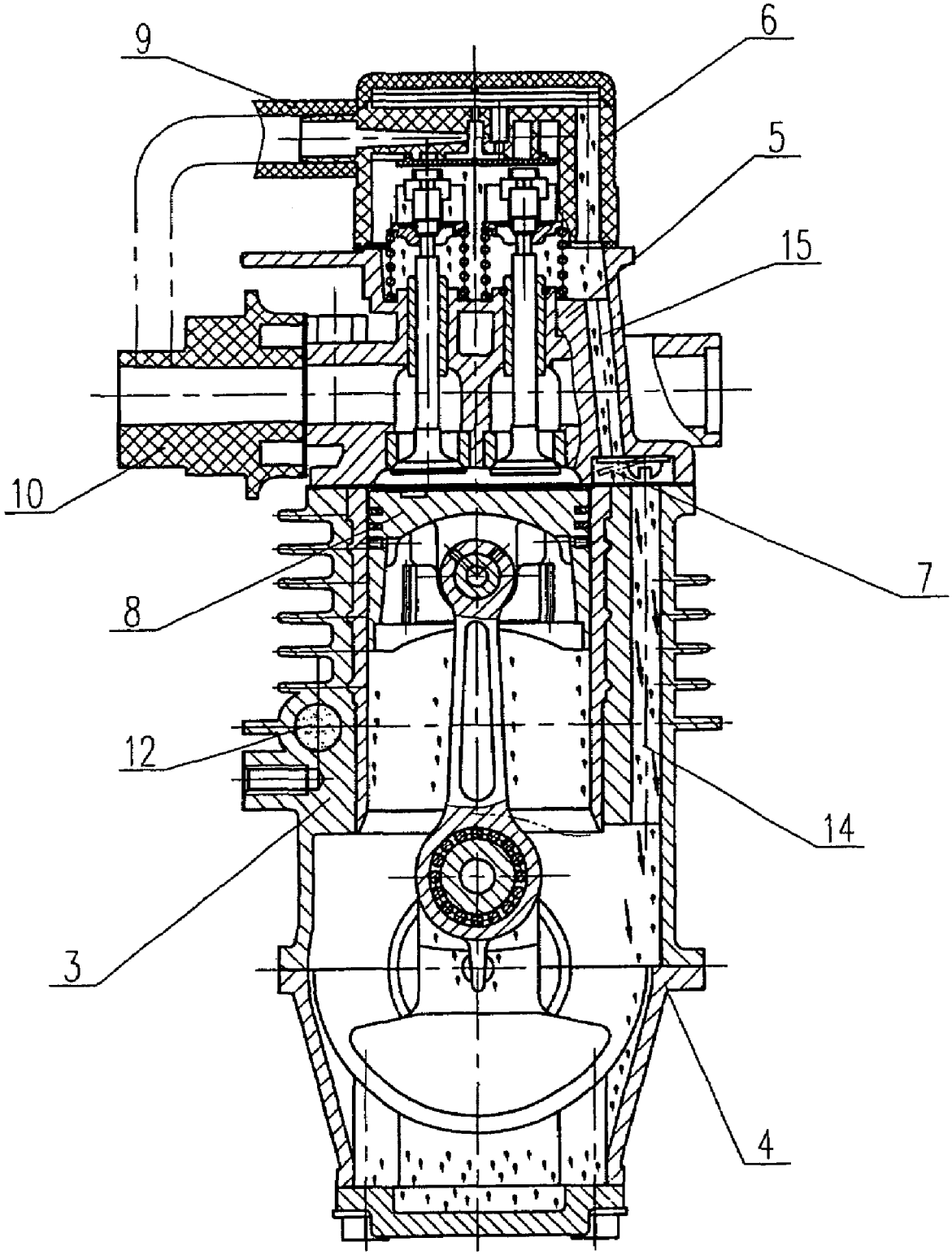
FIG. 2 shows the cross-sectional view as taken along the line A-A of FIG. 1.
Figure 3:
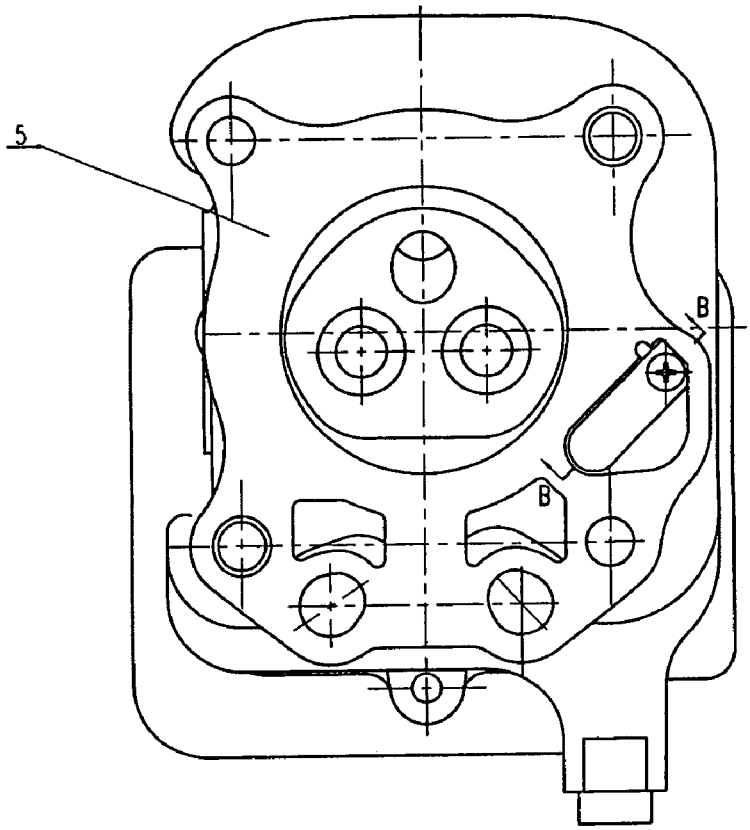
FIG. 3 shows the bottom view of the cylinder head assembly of FIG. 1.
Figure 4:
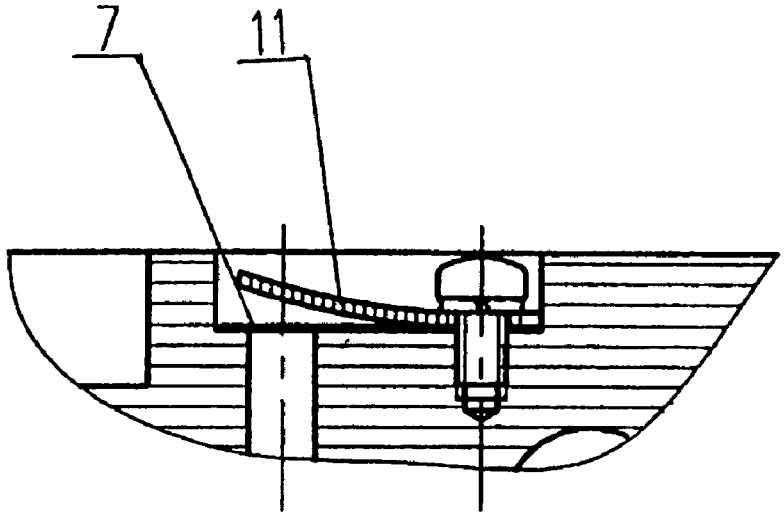
FIG. 4 shows the cross-sectional view as taken along the line B-B of FIG. 3.

When the piston assembly 8 moves upwards, the pressure of the crankshaft chamber B P3 decreases, and the relationship of each chamber's pressure is P3<P4<P1<P2<P0, which is opposite to the relationship when the piston assembly 8 moves downwards. At this point of time, the reed valve 7 is in an open state under the pressure effect, thereby absorbing the lubricant condensed inside the condensation chamber E via the cylinder head oil return way 15, the reed valve 7 and the upper case body oil return way 14 back to the crankshaft chamber B, and via the communication at the bottom the lubricant then returns to the oil mist chamber A. The direction of the oil way backflow is shown in FIG. 2 by the arrow heads therein. The circulation process of the oil mist lubrication is therefore completed.

In conclusion, the present invention changes the conventional lubricating mode fundamentally. The oil mist lubrication is used for the whole system, which makes use of the pressure changes generated by the up and down movements of the piston assembly 8 to attain the circulation of the oil way. The structure is simple and reliable. Each part can be evenly lubricated without any dead angle.

What is claimed is:

1. A small four-stroke gasoline engine with oil mist lubrication comprising:

an upper case body 3 and a lower case body 4, a crankshaft assembly 1, a piston assembly 8, a cylinder head assembly 5, a cylinder head cover 6 and a lubrication oil way of engine, and the lubrication oil way of engine includes a crankshaft chamber B, a camshaft chamber C, an upper rocker arm chamber D and a condensation chamber E, and the camshaft chamber C is connected to the upper rocker arm chamber D via a tappet cavity 13, and the upper rocker arm chamber D communicates with the condensation chamber E, wherein an oil mist chamber A is formed by an upper case body 3 and a lower case body 4 on one side of the crankshaft chamber B, and the bottom of the oil mist chamber A communicates with the crankshaft chamber B, an oilsplash impeller 2 is fixed onto the crankshaft which extends into the oil mist chamber A, an oil way 12 is provided on the upper case body 3 which is in between the oil mist chamber A and the camshaft chamber C, an oil return way 15 is provided on a cylinder head assembly 5, an oil return way 14 is provided on the upper case body 3, and the upper interface of the oil return way 15 communicates with the upper rocker arm chamber D, and its lower interface is connected to the oil return way 14, and the lower interface of the oil return way 14 communicates with the crankshaft chamber B.

2. The small four-stroke gasoline engine with oil mist lubrication as in claim 1, wherein a reed valve 7 is provided at the interface of cylinder head assembly 5 between the oil return way 15 and the oil return way 14.

3. The small four-stroke gasoline engine with oil mist lubrication as in claim 2, wherein a spacing plate 11 is provided on the reed valve 7.

* * * * *

UNITED STATES PATENT AND TRADEMARK OFFICE

CERTIFICATE OF CORRECTION

PATENT NO. : 7,243,632 B2
APPLICATION NO. : 10/569027
DATED : July 17, 2007
INVENTOR(S) : Ji-Rong Hu It is certified that error appears in the above-identified patent and that said Letters Patent is hereby corrected as shown below:

Title Pg, Item (76) Inventor:

The correct name of the Inventor should be "Ji-Rong HU" instead of "Ji-Rong No HU".

Signed and Sealed this

Third Day of March, 2009

John Doll

JOHN DOLL
*Acting Director of the United States Patent and Trademark Office*